US010123662B2

(12) United States Patent
Celia

(10) Patent No.: US 10,123,662 B2
(45) **Date of Patent: *Nov. 13, 2018**

(54) ONE-PIECE FOAM CONSTRUCT

(71) Applicant: Wayne Celia, Woonsocket, RI (US)

(72) Inventor: Wayne Celia, Woonsocket, RI (US)

(73) Assignee: Diversified Global Technologies, LLC, Woonsocket, RI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/234,397

(22) Filed: Aug. 11, 2016

(65) Prior Publication Data

US 2016/0353941 A1 Dec. 8, 2016

Related U.S. Application Data

(62) Division of application No. 13/633,437, filed on Oct. 2, 2012, now Pat. No. 9,439,550.

(51) Int. Cl.

| | |
|---|---|
| ***A47K 7/02*** | (2006.01) |
| ***A47K 7/03*** | (2006.01) |
| ***A47L 13/17*** | (2006.01) |

(52) U.S. Cl.

CPC ..... *A47K 7/03* (2013.01); *A47K 7/02* (2013.01); *A47L 13/17* (2013.01)

(58) Field of Classification Search

CPC ..... A47K 7/02; A47K 7/03
USPC ..... 15/104.93, 104.94, 208
See application file for complete search history.

(56) References Cited

U.S. PATENT DOCUMENTS

| | | | | |
|---|---|---|---|---|
| 4,199,835 | A * | 4/1980 | Heyer | A47L 17/08 15/229.11 |
| 4,243,713 | A * | 1/1981 | Worrall | D02G 3/346 156/148 |
| 5,763,335 | A * | 6/1998 | Hermann | A43B 17/102 442/370 |
| 5,976,616 | A * | 11/1999 | Celia | A61K 8/0208 424/404 |
| 6,280,356 | B1 * | 8/2001 | Sandeen | A63B 43/00 473/614 |
| 6,871,375 | B2 * | 3/2005 | Borcherds | A47K 7/02 15/209.1 |
| 6,957,924 | B1 * | 10/2005 | McMeekin | A45D 44/00 15/208 |
| 7,144,088 | B2 * | 12/2006 | Chang | A47K 7/02 15/209.1 |
| 7,175,239 | B2 * | 2/2007 | Chang | A47K 7/02 15/209.1 |
| 8,141,196 | B2 * | 3/2012 | Chen | A47K 7/02 15/209.1 |
| 9,187,850 | B1 * | 11/2015 | Sheffer | A47L 13/30 |
| 9,439,550 | B2 * | 9/2016 | Celia | A47L 13/17 |
| 2002/0152571 | A1 * | 10/2002 | Lee | A47K 7/02 15/209.1 |
| 2003/0191204 | A1 * | 10/2003 | Hermann | A01K 1/0152 521/82 |
| 2007/0021566 | A1 * | 1/2007 | Tse | C09D 123/10 525/240 |

(Continued)

*Primary Examiner* — Michael Jennings
(74) *Attorney, Agent, or Firm* — IP Attorneys Group

(57) ABSTRACT

The invention relates to a one-piece foam construct reversibly assembled by at least one binder, as well as the methods of making and assembling said one-piece foam construct. The construct is meant for use as a cleaning implement.

16 Claims, 13 Drawing Sheets

(56) References Cited

U.S. PATENT DOCUMENTS

| | | | | |
|---|---|---|---|---|
| 2009/0038103 | A1* | 2/2009 | Chang | A47K 7/02 15/244.4 |
| 2011/0138565 | A1* | 6/2011 | Dunshee | A47K 7/02 15/210.1 |
| 2011/0262737 | A1* | 10/2011 | Fung | B32B 3/26 428/317.3 |
| 2012/0022178 | A1* | 1/2012 | McCluskey | B29C 44/5618 521/170 |

* cited by examiner

ONE-PIECE FOAM CONSTRUCT

CROSS REFERENCE TO CO-PENDING APPLICATIONS

This application is a divisional of and claims priority to U.S. application Ser. No. 13/633,437 filed on Oct. 2, 2012 and titled "One-Piece Foam Construct." The contents of this above-referenced application are relied upon and are incorporated herein by reference in their entireties.

FIELD OF INVENTION

The invention relates to a one-piece foam construct for use as a cleaning implement and a method of constructing the same.

BACKGROUND OF INVENTION

Present cleaning implements could be broken down into two main categories: cloth hand towels or sponges. Sponges are typically capable of absorbing and subsequently applying a higher volume of material than cloth hand towels. Regarding cleaning sponges, they can usually be composed of natural or synthetic materials and sometimes combinations of both. Sponges may have a porous structure, allowing uptake of water and cleaning material, such as a soap, into said sponge, for application onto a surface, such as the user themselves. Cleaning sponges often come in two varieties: a consistently dense, porous shape, or a roughly spherical shape having a dense core of compressed spongy material and substantially less dense outer shell of uncompressed projections. The dense core sponges can be difficult to manufacture, as the cores are often irreversibly bound to keep the shape of the sponge consistent from use to use. This can also make the dense core sponges difficult to clean, as dirt and excess soap may get trapped in the dense core and crevices surrounding it, potentially leading to shorter operational lifetimes. While the consistently dense sponges may be easier to clean, they also lack the available surface area of the dense core sponges, which can allow for better application of cleaning material to a surface and more efficient cleaning.

What is desired, therefore, is a high quality cleaning implement with high surface area, that is both easy to produce and simple to clean. When used as cleaning implements, a hand towel or sponge is typically soaked in water, a cleaning agent is applied, and the towel or sponge is rubbed across the surface to be cleaned. In this manner of use, the amount of cleaning agent that can be applied is limited by the surface of the cleaning implement, and the cleaning agent must be regularly reapplied. Any other agents which may be desirably applied to the skin must also be applied first to the cleaning implement, and repetitively applied as it is used.

It is also desired therefore that the cleaning implement have advanced functionality, such that some cleaning agents or other additives would not need to be constantly reapplied.

SUMMARY OF INVENTION

It is therefore an object of this invention to provide a foam construct for use as a cleaning implement. In one embodiment, the foam construct comprises a foam strip having one or more cuts on both the left and right side, which is then rolled tightly and the middle portion secured in a compressed state. In some embodiments, the foam contains one or more additives. In some embodiments, these additives are released in a controlled manner on contact with water. In various embodiments, these additives are chosen from soaps, detergents, skin care agents, hydrocolloid absorptive agents, medicaments, proteins, enzymes, nucleic acids, vitamins, hemostatic agents, antibacterial agents, antifungal agents, surfactants, pH buffers, rubber particles, disinfecting and sterilizing agents, thermal phase change particles, and combinations thereof. In some embodiments, this construct is in the form of a sponge which has a dense core, can be opened for cleaning, and contains one or more additives which are released in a controlled manner on contact with water.

In some embodiments, the foam construct is reversibly secured by a binder, which is removed to unroll the foam for cleaning, and after the foam is rerolled, is reattached to secure the foam for use. In some embodiments, the binder may also include a section which may be used as a handle. In other embodiments, an additional binder may be added to provide a handle.

In one embodiment, the additional binder has a stopper section, thicker than the remaining portion of the binder, to help prevent it from being pulled through the construct during use. In this embodiment, the additional binder is rolled up in the center of the foam construct such that the stopper section is on one side of the construct and the portion of the additional binder on the other side of the construct is used as a handle. When the initial binder is applied to compress the foam, the additional binder is retained in the center of the construct to act as a handle. In other embodiments, the additional binder is attached directly to the foam strip. In still other embodiments, the additional binder is attached to the initial binder.

One embodiment of the invention comprises a rolled, one-piece, foam strip having at least one additive selected from the group consisting of soaps, detergents, skin care agents, hydrocolloid absorptive agents, medicaments, proteins, enzymes, nucleic acids, vitamins, hemostatic agents, antibacterial agents, antifungal agents, surfactants, pH buffers, rubber particles, disinfecting and sterilizing agents, thermal phase change particles, and combinations thereof. This foam strip has a plurality of cuts along both the left and right portion, and a removable binder securing a portion of the foam strip in a compressed conformation. The additional binder with a stopper section somewhat larger than the rest of the binder is applied to the strip. In one embodiment, this additional binder is rolled in the center of the foam strip, with enough of its length protruding from the construct to use as a handle.

It is also an object of this invention to provide a method of making a foam construct for use as a cleaning implement. In some embodiments, this comprises the steps of providing a foam strip having a left portion, a right portion, and a middle portion, providing at least one cut in at least one of the left or right portions, compressing the foam strip, and securing the foam strip on the middle portion in the compressed form. In some embodiments, the step of mixing a prepolymer, water, and an additive is added to provide the foam strip. In some embodiments, the admixed additive is selected from soaps, detergents, skin care agents, hydrocolloid absorptive agents, medicaments, proteins, enzymes, nucleic acids, vitamins, soaps, hemostatic agents, antibacterial agents, antifungal agents, surfactants, pH buffers, rubber particles, disinfecting and sterilizing agents, thermal phase change particles, and combinations thereof. In some embodiments, the foam strip is compressed by rolling the foam strip. In some embodiments, the foam strip is secured by applying at least one binder to the foam strip. In one embodiment, this binder is applied to the middle portion of the rolled foam strip. In one embodiment, said additional binder has an enlarged stopper section is rolled up inside the foam strip, which is then secured with an additional binder.

BRIEF DESCRIPTION OF FIGURES

The features of the invention believed to be novel and the elements characteristic of the invention are set forth with particularity in the claims. The figures are for illustration purposes only. The invention itself, however, both as to organization and method of operation, may be understood by reference to the detailed description which follows taken in conjunction with the accompanying drawings in which the drawings show typical embodiments of the invention and are not intended to be limiting of its scope.

DETAILED DESCRIPTION OF DRAWINGS

In describing the various embodiments of the instant invention, reference will be made herein to FIGS. 1-5 in which like numerals refer to like features of the invention.

Figure 5:
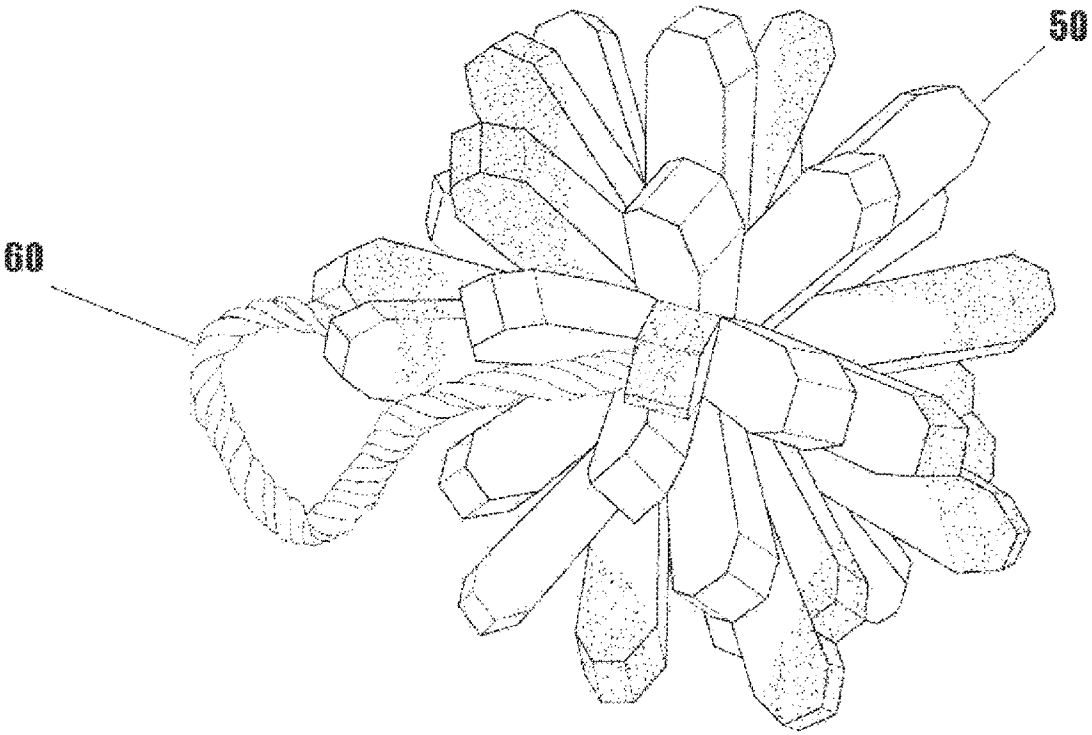
FIG. 5 depicts a fully rolled and fastened cleaning implement as constructed from the one-piece foam strip as depicted in FIG. 1.

FIG. 5 shows the finished foam construct of one embodiment of the invention, formed from a one-piece foam strip as described below, and two binders. Projections (50) from a central dense core form the surface, while an end of one binder protrudes far enough to form a handle (60).

Figure 1:
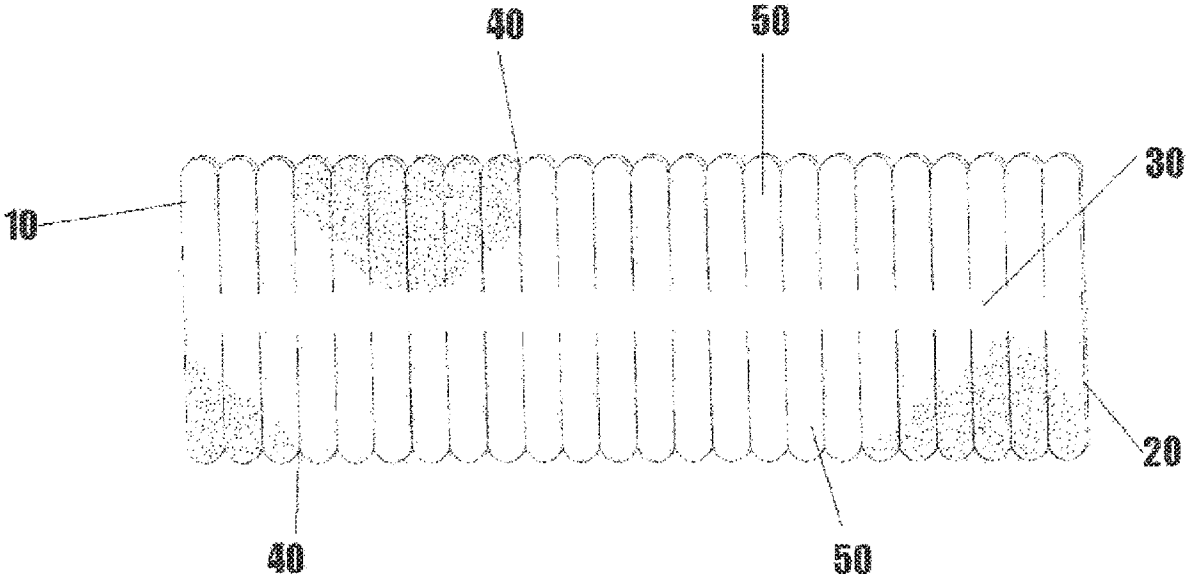
FIG. 1 depicts a one-piece foam strip as used in one embodiment of the present invention.

FIG. 1 depicts a one-piece foam strip having a left portion (10), a right portion (20) and a middle portion (30). Cuts (40) are provided along the left portion and the right portion, to leave projections or fingers of foam (50) projecting from the middle portion. The nature and preparation of some polymer foams suitable for use in this invention reflect in part the teachings with regard to hydrophilic polyurethane foams of U.S. Pat. Nos. 5,976,616, 6,706,775, and 6,566,576, which are hereby incorporated by reference in their entirety. In one embodiment of the invention, the polymer foam comprising the foam strip is prepared by polymerization of an aqueous prepolymer mixture. The aqueous prepolymer mixture comprises adequate water, a predetermined amount of a hydrophilic urethane polymer, and any desired additives. These additives comprise soaps, detergents, skin care agents, hydrocolloid absorptive agents, medicaments, proteins, enzymes, nucleic acids, vitamins, hemostatic agents, antibacterial agents, antifungal agents, surfactants, pH buffers, rubber particles, disinfecting and sterilizing agents, thermal phase change particles, and combinations thereof.

In some embodiments, one or more additional components are added to modify the properties of the resulting foam. In various embodiments, these components include dispersants to ensure that the components of the aqueous prepolymer mixture are adequately dispersed throughout the foam; surfactants to modify the hydrophilicity of the resulting polymer foam, foaming and blowing agents to modify the number, size, and uniformity of the cells in the resulting foam, and superabsorbent polymers for controlled release of the dispersed additives or to modify the water-absorbing or water-releasing properties of the foam. Other components which are present in certain embodiments include one or more polymer initiators, dyes, cross-linking agents, catalysts, or polymer-chain size modifiers. In some embodiments, combinations of additional components are added to the prepolymer mixture. The quantities and identities of such components can be readily determined by one skilled in the art based on the desired properties of the resulting foam. Although certain prepolymers and structural features of the additives listed below in some cases also act as polymer initiators, dyes, cross-linking agents, catalysts, or polymer-chain-size modifiers, for the purpose of this patent, these components when claimed separately are defined to be distinct from the prepolymers and additives present in the mixtures.

In some embodiments of the invention, superabsorbent polymers are added for controlled release of the dispersed additives or to modify the water-absorbing or water-releasing properties of the foam. Suitable superabsorbent polymers and their characteristics can be found for example in U.S. Pat. Nos. 5,763,335 and 4,914,470, hereby incorporated by reference in their entirety. In general, superabsorbents are considered to be water-insoluble materials which are capable of absorbing and retaining large amounts of water or other aqueous fluids in relation to their own weight. In some industrial applications, compounds are considered to be superabsorbent when they can absorb at least fifteen times their own weight of aqueous fluids.

In some embodiments, the polymer foam is a hydrophilic urethane foam. Hydrophilic urethane prepolymers are available in the commercial marketplace, for example, those sold under the trademark BIPOL 6 by Mace Adhesives and Coatings, under the trademark HYPOL by The Dow Chemical Company, or under the trademark PREPOL by Lendall Manufacturing Incorporated. General procedures for the preparation and formation of such prepolymers can be found in Polyurethane's Chemistry and Technology by J. H. Saunders and K. C. Frisch published by John Wiley & Sons, New York, N.Y., at Vol. XVI Part 2. High Polymer Series, "Foam systems". Pages 7-26, and "Procedures for the Preparation of Polymers", pages 26 et. seq. Admixing an aqueous mixture with a predetermined amount of the hydrophilic urethane prepolymer initiates polymerization. The physical characteristics of the resulting polymer foam, such as density and tensile strength, are controlled by the ratio of prepolymer in the aqueous mixture.

In some embodiments, one or more agents including cross-linking agents, catalysts, or surfactants are added to the mixture to further modify the physical characteristics of the resulting polymer foam. Cross-linking agents are small multifunctional compounds that, under the appropriate reaction conditions, form additional cross-links between segments of the polymer. In some embodiments, these additional crosslinks increase the stiffness, strength, or toughness of the resulting foam. In some embodiments they can be used to link the collagen or the additives to the matrix of the polymer foam. In some embodiments they can be used to add other desirable functionality to the resulting foam such as color, hydrophilicity, visible or ultraviolet light resistance or sensitivity, and resistance to oxidative degradation.

Catalysts are materials which are used to modify the reaction rate of the polymerization reaction. In some embodiments, they are added to promote the polymerization reaction under specific conditions of heat or light activation, allowing control of such variables as pot life and reaction temperature of the prepolymer mixture, and cell formation, number, and size in the resulting foam. Some catalysts suitable for use in polyurethane systems include those sold under the trademark BiCAT by Shepherd Chemical Company and those sold under the trademarks DABCO and POLYCAT by Air Products.

Surfactants are compounds which are added to increase the solubility of other materials in the aqueous prepolymer mixture. In some embodiments, they are added as part of the aqueous collagen mixture or used to prepare an aqueous solution of other agents or additives before addition to the prepolymer mixture. In some embodiments, the surfactants are present in amounts of about 0.5% to about 5% by weight of the aqueous mixture. A wide variety of anionic, cationic, non-ionic, and zwitterionic surfactants are commercially available, and the choice of surfactant can be readily determined by one skilled in the art based on the nature of the materials to be dissolved. In some embodiments, surfactants are used to modify the resulting polymer foam by controlling the number or size of the cells, and in some embodiments the incorporation of the surfactant in the polymer matrix is used to modify the hydrophilicity of the resulting foam.

Figure 2:
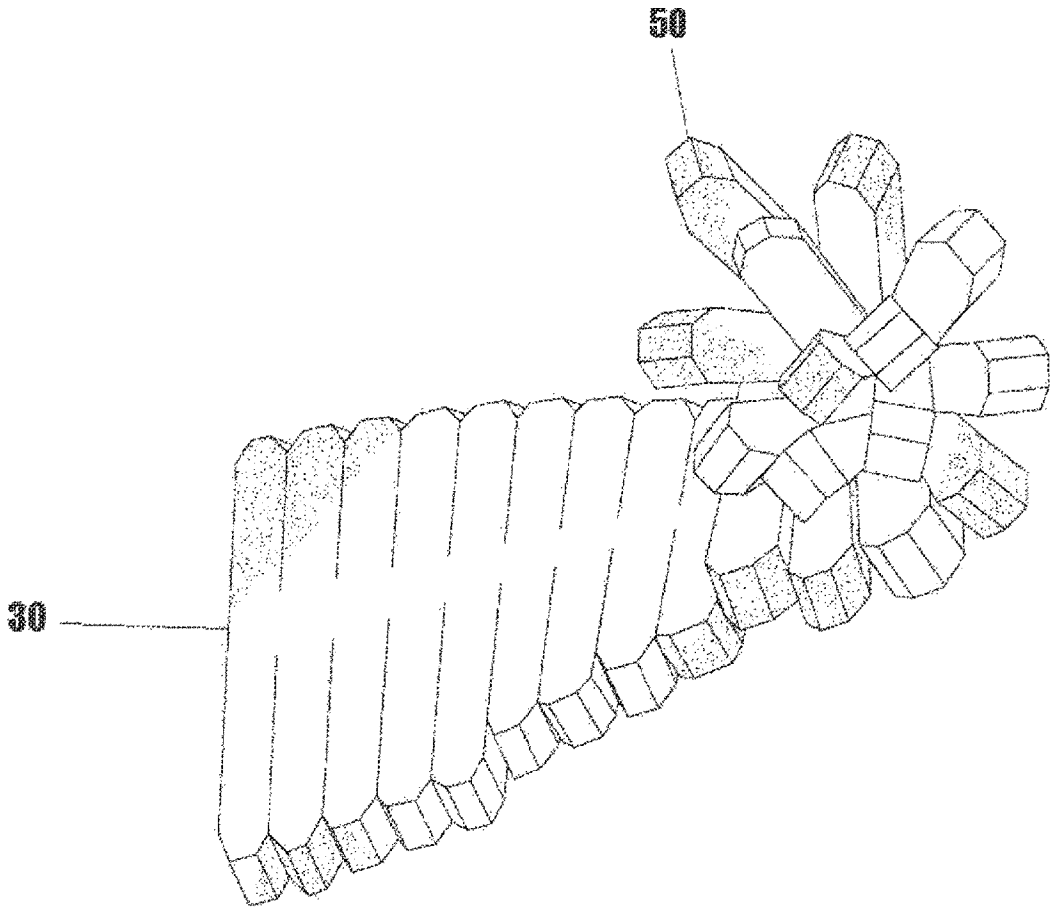
FIG. 2 depicts a partially rolled one-piece foam strip as depicted in FIG. 1.
Figure 3:
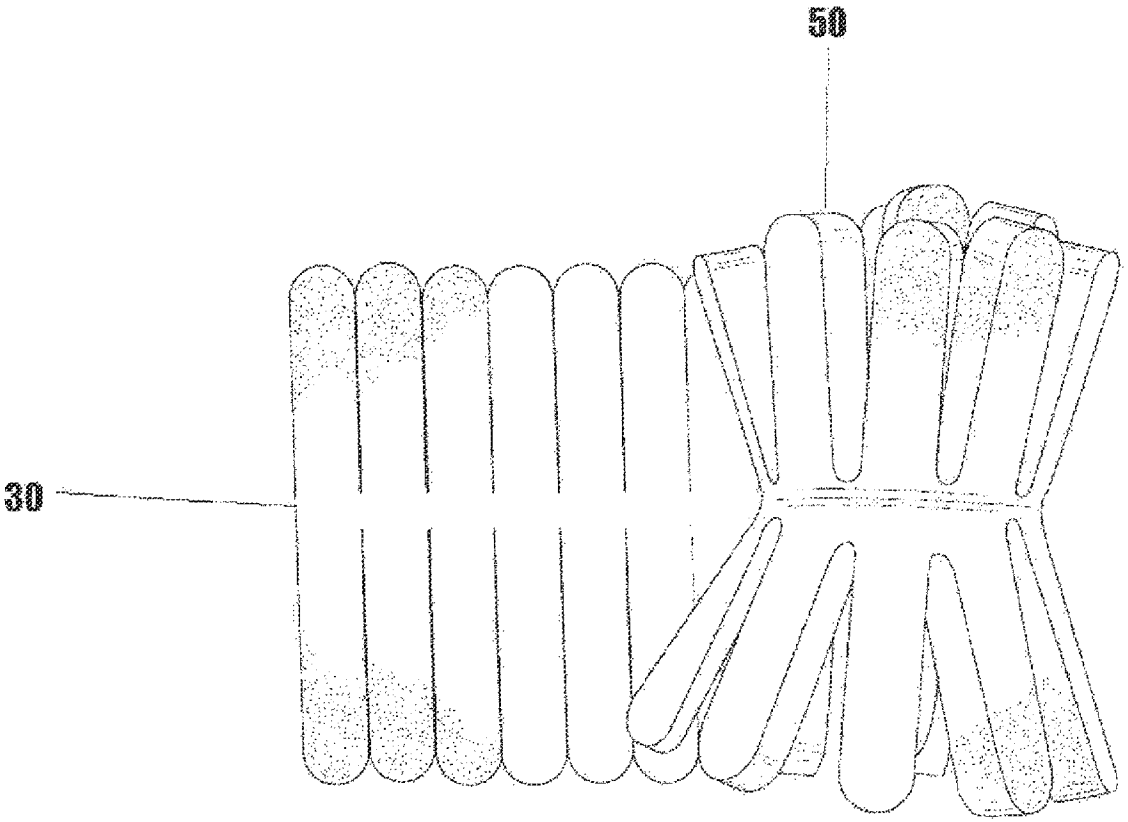
FIG. 3 depicts a partially rolled one-piece foam strip as depicted in FIG. 1.
Figure 4:
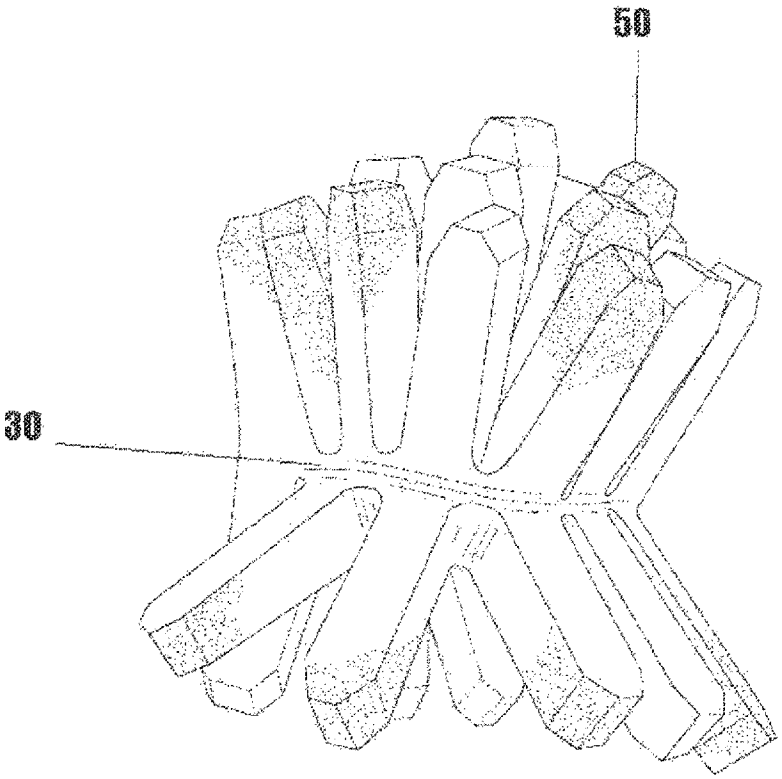
FIG. 4 depicts a partially rolled one-piece foam strip as depicted in FIG. 1.

FIGS. 2, 3, and 4 depict the one-piece foam shown in FIG. 1 as it is formed into a cleaning implement of the instant invention. As the foam strip is rolled, the middle portion (30) is compressed to form a denser core, while the projections or fingers (50) are pulled away from each other by the compression of the center. These projections form a substantially less dense outer shell having a much larger surface area than would a consistently dense sponge occupying the same space. This density gradient, along with the hydophilicity of the foam itself, provides a cleaning implement capable of retaining substantial amounts of water and cleaning solution for application to a surface, such as the human body.

Figure 7:
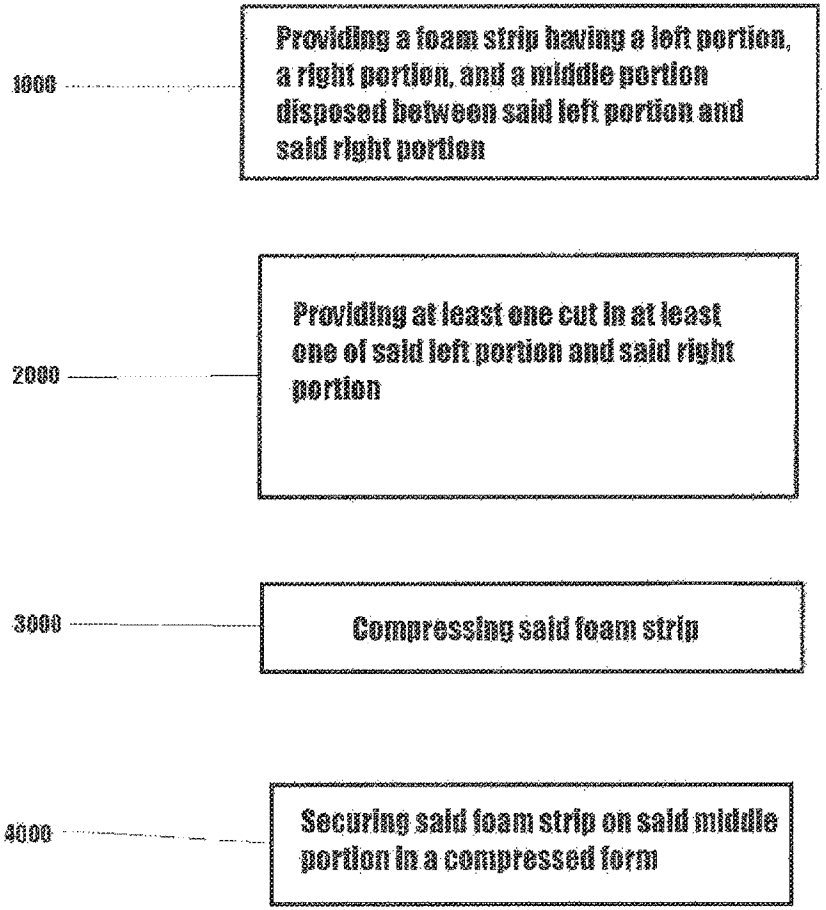
FIG. 7 is a flowchart depicting a method for providing a foam construct in accordance with the present invention.
Figure 8:
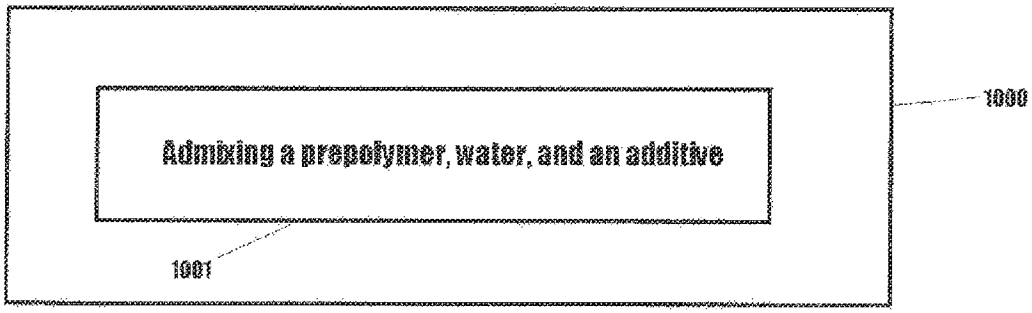
FIG. 8 depicts an additional embodiment of the method in FIG. 7, further comprising the step of admixing a prepolymer, water, and an additive.

FIG. 7 depicts another embodiment of this invention, a method for providing a foam construct for use as a cleaning implement, comprising the steps of providing a one-piece foam strip having a left portion, right portion, and middle portion disposed between said left portion and said right portion (1000), providing at least one cut in at least one of the left or right portion (2000), compressing the foam strip (3000), and securing the strip in a compressed form (4000). In various embodiments, such as that depicted in FIG. 8, providing a foam construct comprises one or more of the additional steps of admixing (1001) a prepolymer, water, and one or more additives, allowing the mixture to polymerize, sizing and forming the resulting polymer foam, and drying the foam. In one embodiment, the mixture is sized and formed as it is polymerizing. In various embodiments, the additives are selected from the group consisting of soaps, detergents, skin care agents, hydrocolloid absorptive agents, medicaments, proteins, enzymes, nucleic acids, vitamins, hemostatic agents, antibacterial agents, antifungal agents, surfactants, pH buffers, rubber particles, disinfecting and sterilizing agents, thermal phase change particles, and combinations thereof.

Figure 9:
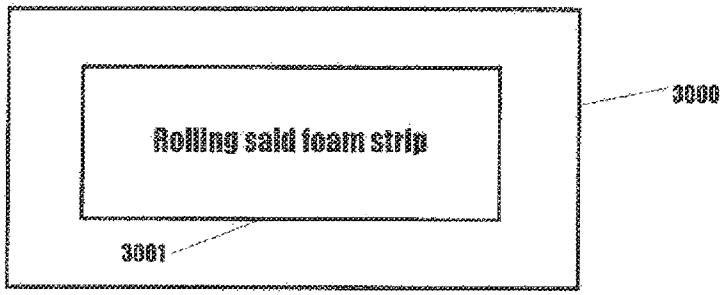
FIG. 9 depicts an additional embodiment of the method in FIG. 7, further comprising the step of rolling a foam strip.
Figure 10:
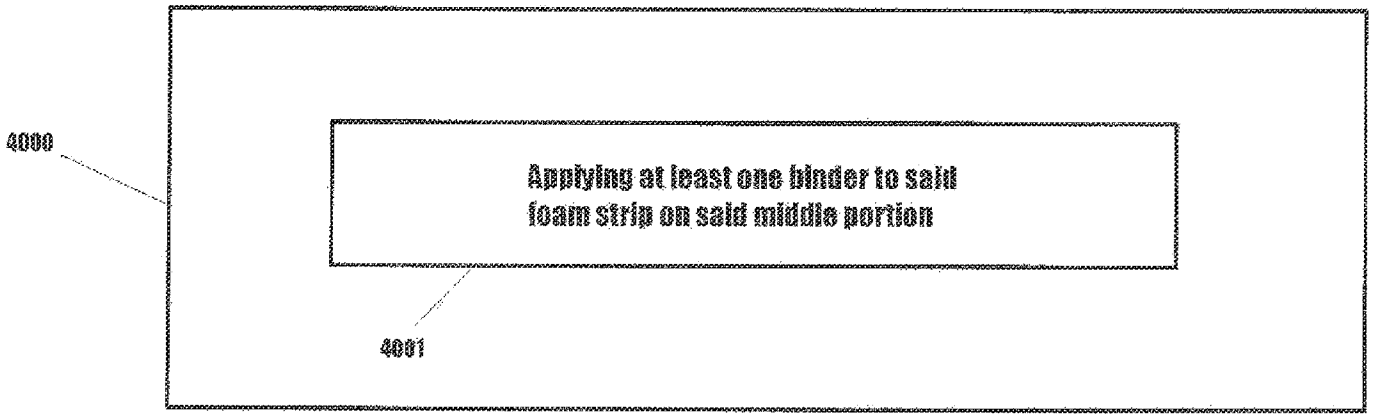
FIG. 10 depicts an additional embodiment of the method in FIG. 7, further comprising the step of applying at least one binder to said foam strip on said middle portion.
Figure 11:
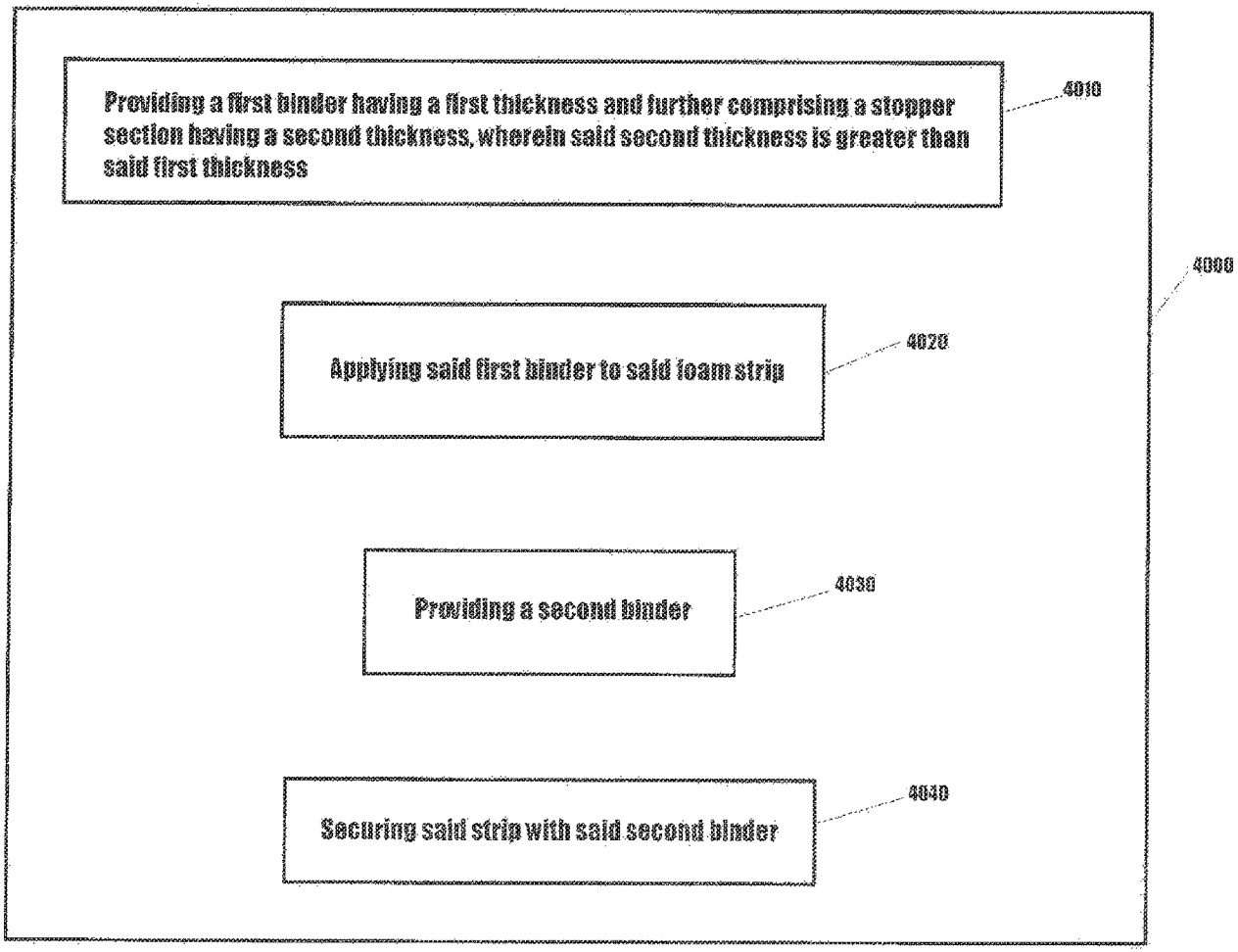
FIG. 11 depicts an additional embodiment of the method in FIG. 7, further comprising steps drawn to providing multiple binders.

In some embodiments, such as that depicted in FIG. 9, the step of compressing (3000) the strip further comprises the step of rolling (3001) the strip. In some embodiments, such as that depicted in FIG. 10, the step of securing (4000) the strip in a compressed form further comprises the step of applying (4001) at least one binder to said foam strip. In many embodiments, this binder is applied to the middle portion of the foam strip, maintaining the compression of the middle portion while the projections of the outer portions spread to form a roughly spherical perimeter. In other embodiments, a first binder having an enlarged stopper section is provided (4010) and applied (4020) to the foam strip before it is rolled, and a second binder is provided (4030) to secure (4040) the strip after it is rolled.

In some embodiments, the binder or binders are reversibly applied, meaning that the one-piece foam strip may be easily deconstructed into its component parts and reassembled just as easily. This functionality allows for easier washing and rinsing of the construct, wherein diligent care will prevent soap or other material from collecting and remaining the spaces between the protrusions or fingers.

Figure 6A:
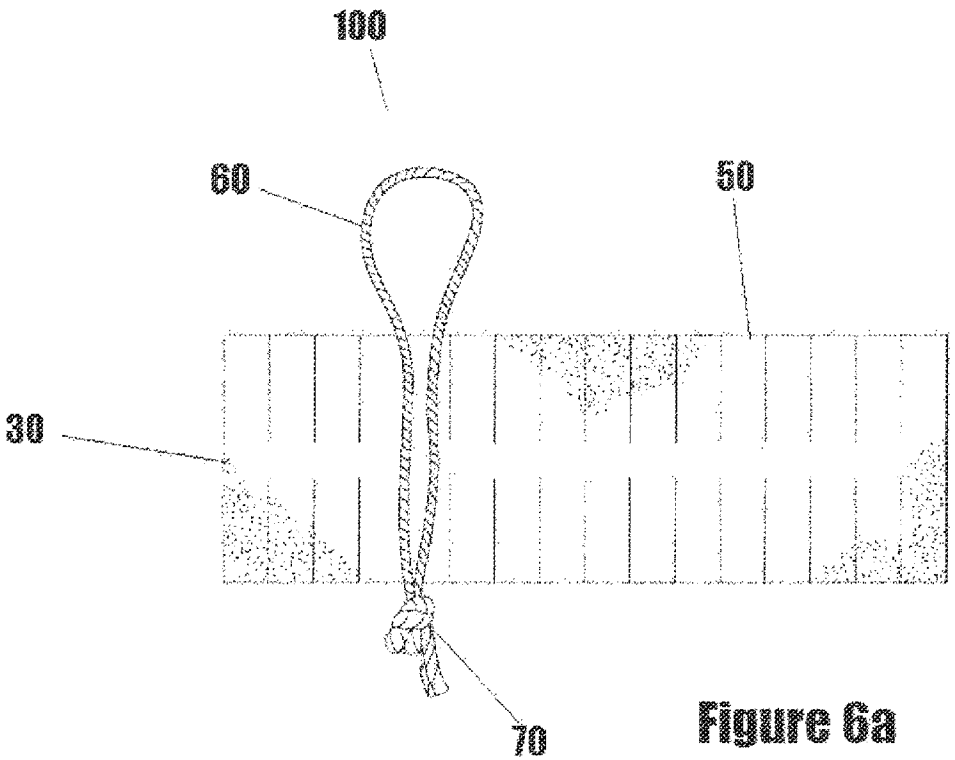
FIGS. 6*a*-6*c* depict the rolling and fastening of the one-piece foam strip as depicted in FIG. 1.
Figure 6B:
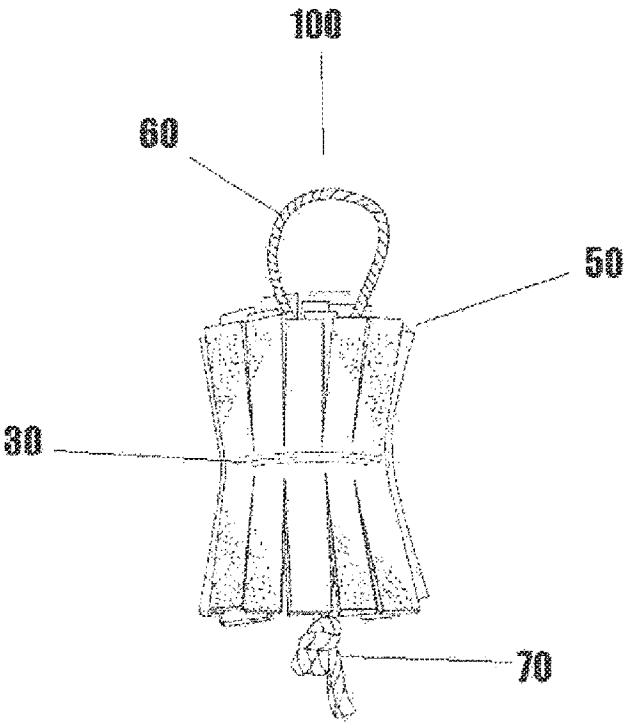
Figure 6C:
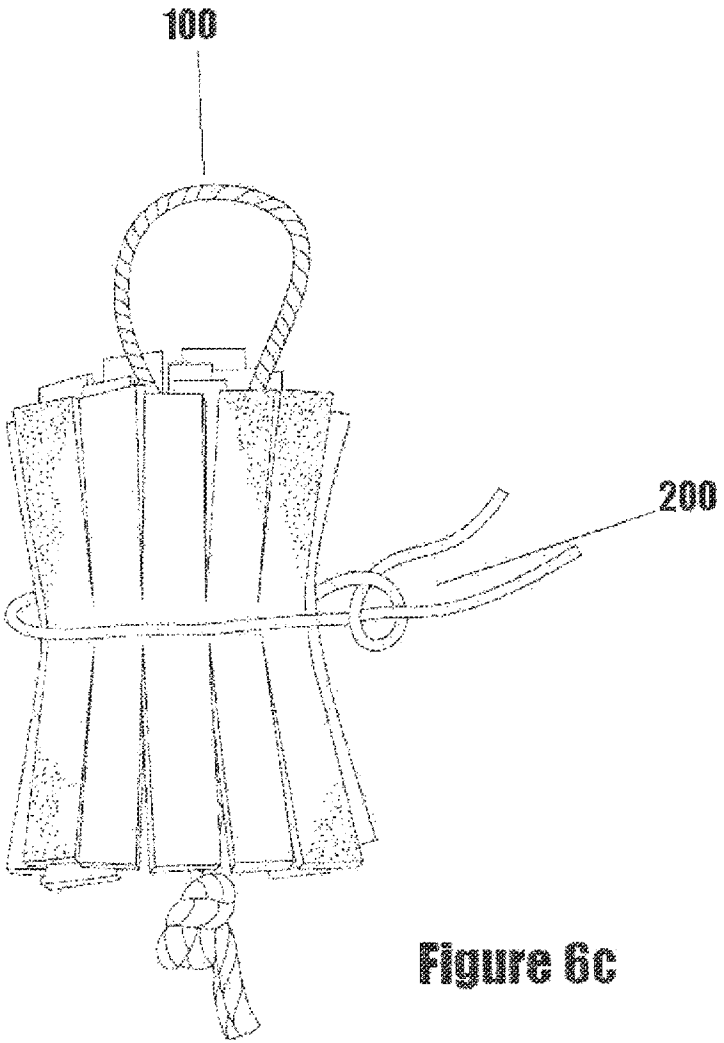

FIGS. 6*a*-6*c* show the same construction process as described above and includes the addition of a binder to hold the one-piece foam construct of the instant invention in its final, compressed state. In one embodiment, the rolled construct as depicted in FIG. 4 is secured around middle portion (30) by a second binder (200). FIG. 6*c* depicts a string and knot arrangement for securing the construct in a compressed state, but other suitable binding techniques may be employed. In some embodiments, the second binder (200) is selected from the consisting of pins, staples, adhesives, plastic ties, fabric ties, rings, and the like. In another embodiment, the construct uses two binders to create keep it in a secure state. FIGS. 6*a* and 6*b* show this process and includes a first binder (100) rolled into the inside of the construct. In one embodiment this binder is a flexible material, looped to form a handle (60), and tied at one end to form a stopper (70) substantially larger than the remaining length of binder. This stopper prevents the binder from pulling through the compressed foam construct when the protruding length of the binder is used as a handle. In various embodiments, the first binder (100) is formed from a suitable length of cord, rope, string, yarn, thread, ribbon, cloth, chain, cable, rubber tubing, thin flexible rod, knit tubing, or other substantially flexible material. In one embodiment, the stopper is a knot in the end of the binder. In an additional embodiment, the stopper incorporates an additional component such as a button, knob, tube, disc, bead, or annulus. In further embodiments, other materials or thicknesses are incorporated into the binder to act as a handle, including knotwork, tubes, beads, tapes, and rigid materials without departing from the spirit of the invention. The addition of a second binder as described above allows a user to more easily grasp, hold, and manipulate the foam construct.

While the present invention has been particularly described, it is evident that many alternatives, modifications and variations will be apparent to those skilled in the art in light of the foregoing description. It is therefore contemplated that the appended claims will embrace any such alternatives, modifications, and variations as falling within the true scope and spirit of the present invention.

What is claimed is:

1. A foam construct for use as a cleaning implement comprising:

A foam strip having at least a left portion and a right portion;

A middle portion disposed between said left portion and said right portion;

At least one cut on at least one of said left portion and said right portion;

a first binder and a second binder, wherein said second binder holds the foam strip in a rolled state and said first binder comprises a handle;

wherein said first binder has a first thickness and further comprises at least one stopper section having a second thickness, wherein said second thickness is thicker than said first thickness;

wherein said middle portion is secured in a compressed state;

wherein said first binder passes through a center of said middle portion such that the stopper section is on one side of the construct and the handle is on the other side of the construct, wherein the stopper prevents the first binder from pulling through the foam construct when it is in the rolled state; and wherein said foam construct further comprises at least one additive, wherein said at least one additive is an antibacterial agent.

2. The foam construct for use as a cleaning implement of claim 1, wherein said foam construct further comprises at least a second additive.

3. The foam construct for use as a cleaning implement of claim 2, wherein said at least second additive is chosen from the group consisting of: soaps, detergents, skin care agents, hydrocolloid absorptive agents, medicaments, proteins, enzymes, nucleic acids, vitamins, hemostatic agents, antibacterial agents, antifungal agents, surfactants, pH buffers, rubber particles, disinfecting and sterilizing agents, thermal phase change particles, and combinations thereof.

4. The foam construct for use as a cleaning implement of claim 2, wherein said foam construct further comprises at least one component.

5. The foam construct for use as a cleaning implement of claim 4, wherein said at least one component is chosen from the group consisting of:

dispersants, surfactants, foaming and blowing agents, superabsorbent polymers, polymer initiators, dyes, cross-linking agents, catalysts, and polymer-chain size modifiers.

6. The foam construct for use as a cleaning implement of claim 1, wherein said at least one cut is a plurality of cuts applied to both said left portion and said right portion.

7. The foam construct for use as a cleaning implement of claim 1, wherein said second binder is reversibly applied.

8. The foam construct for use as a cleaning implement of claim 1, wherein said first and second binders are selected from the group consisting of: ties, adhesives, and fasteners.

9. The foam construct for use as a cleaning implement of claim 1, wherein when the foam strip is in a rolled state and the middle portion is in a compressed state, a density gradient is formed by a dense core and a less dense outer shell comprising projections of the left portion and the right portion of the foam strip.

10. A method of making a foam construct for use as a cleaning implement comprising the steps of:

Providing a foam strip having a left portion, a right portion, and a middle portion disposed between said left portion and said right portion;

Providing at least one cut in at least one of said left portion and said right portion;

Providing a first binder that passes through a center of said middle portion such that a stopper section of the first binder is on one side of the foam construct and a handle section of the first binder is on the other side of the foam construct;

Compressing said foam strip such that it encloses the first binder;

Securing said foam strip on said middle portion in a compressed state such that the stopper section is prevented from being pulled through the foam construct by the handle section;

Adding at least one component, wherein said component is a superabsorbent polymer capable of absorbing at least 15 times its own weight in aqueous fluid; and Adding a blowing agent.

11. The method of making a foam construct for use as a cleaning implement of claim 10, wherein the step of providing a the foam strip further comprises the step of:

admixing a prepolymer, water, and an additive.

12. The method of claim 11, wherein said admixed additive is chosen from the group consisting of: soaps, detergents, skin care agents, hydrocolloid absorptive agents, medicaments, proteins, enzymes, nucleic acids, vitamins, hemostatic agents, antifungal agents, pH buffers, rubber particles, disinfecting and sterilizing agents, thermal phase change particles, and combinations thereof.

13. The method of making a foam construct for use as a cleaning implement of claim 10, wherein the step of compressing the foam strip further comprises the step of:

Rolling said foam strip.

14. The method of making a foam construct for use as a cleaning implement of claim 10, wherein the step of securing said foam strip in a compressed state comprises the step of:

Applying a second binder to said foam strip on said middle portion.

15. The method of claim 10, further comprising the step of adding at least a second component.

16. The method of claim 15, further comprising the step of adding at least a second component selected from the group consisting of:

dispersants, surfactants, foaming and blowing agents, superabsorbent polymers, polymer initiators, dyes, cross-linking agents, catalysts, and polymer-chain size modifiers.

* * * * *